US005116043A

United States Patent [19]

Jermann et al.

[11] Patent Number: 5,116,043

[45] Date of Patent: May 26, 1992

[54] METHOD OF AND APPARATUS FOR WINDING SQUARE FOLDED SHEET-LIKE PRODUCTS ON A ROTARY CORE

[75] Inventors: Daniel Jermann, Somerset, N.J.; Bruno Müller, Wikon, Switzerland

[73] Assignee: Grapha-Holding AG, Hergiswil, Switzerland

[21] Appl. No.: 704,372

[22] Filed: May 23, 1991

[30] Foreign Application Priority Data

Feb. 13, 1991 [CH] Switzerland ..... 446/91

[51] Int. Cl.[5] ..... B65H 31/28

[52] U.S. Cl. ..... 271/213; 271/216; 242/59

[58] Field of Search ..... 271/207, 213, 216; 242/59

[56] References Cited

U.S. PATENT DOCUMENTS

| | | | |
|---|---|---|---|
| 4,523,751 | 6/1985 | Merkli | 270/60 |
| 4,528,794 | 7/1985 | Thierstein | 271/213 X |
| 4,538,397 | 9/1985 | Boss | 53/430 |
| 4,589,603 | 5/1986 | Müller | 242/59 |
| 4,752,176 | 6/1988 | Linder | 414/278 |
| 4,768,768 | 9/1988 | Reist | 271/216 X |

FOREIGN PATENT DOCUMENTS

| | | |
|---|---|---|
| 0135080 | 9/1987 | European Pat. Off. . |
| 0316563 | 5/1989 | European Pat. Off. . |
| 2207556 | 8/1973 | Fed. Rep. of Germany . |
| 2544135 | 4/1977 | Fed. Rep. of Germany . |

*Primary Examiner*—Richard A. Schacher
*Attorney, Agent, or Firm*—Peter K. Kontler

[57] ABSTRACT

A stream of square folded sheets, wherein one marginal portion is thicker than the marginal portion which is parallel thereto, is fed into the nip of a rotary core and one or more flexible bands which are being convoluted onto the core whereby the sheets form a roll having convolutions which alternate with the convolutions of the band or bands. The thicker marginal portions of the sheets are fed in a direction at right angles to the axis of rotation of the core so that, in the absence of any undertaking to the contrary, the diameter of the respective end face of the roll would exceed the diameter of the other end face which is formed by the thinner marginal portions of the sheets. The development of such frustoconical roll is prevented by moving the single band or one of several bands close to that end face of the roll which is formed by the thicker marginal portions of the sheets and by maintaining the thus positioned band under requisite tension in order to compress the thicker marginal portions. The difference between the thicker and thinner marginal portions of the sheets can be monitored and the position(s) of one or more bands can be adjusted in automatic response to detection of the difference.

20 Claims, 4 Drawing Sheets

METHOD OF AND APPARATUS FOR WINDING SQUARE FOLDED SHEET-LIKE PRODUCTS ON A ROTARY CORE

BACKGROUND OF THE INVENTION

The invention relates to improvements in methods of and in apparatus for manipulating sheet-like products, and more particularly to improvements in methods of and in apparatus for winding successive products of a series of non-overlapping or partially overlapping sheet-like products on a rotary core.

It is well known to store streams of partially overlapping or non-overlapping discrete paper sheets or sets of paper sheets on a rotary core so that the sheets are converted into a roll having a plurality of convolutions the innermost of which directly surrounds the core and the outermost of which is exposed. Such procedure is often resorted to for temporary storage of brochures or newspaper sections, for example, for temporary storage of sections which are to appear in the Sunday or weekend editions of daily newspapers. Apparatus which are utilized to wind flexible sheet-like products onto rotary cores further comprise flexible bands which cooperate with the cores in order to ensure that the products remain convoluted on their core or on previously convoluted products for a desired interval of time. To this end, each core is connected or connectable with one end of a single band or with one end of each of two or more bands in such a way that the band or bands are wound onto the rotating core and form convolutions which alternate with the convolutions of the growing roll. The outermost convolution of the single band or the outermost convolutions of two or more bands surround the outermost convolution of the fully grown roll.

It is often necessary to store sheet-like products wherein one marginal portion is thicker than the other marginal portions. Typical examples of such products are so-called square folded paper sheets wherein at least one of the four marginal portions is or can be much thicker than the marginal portion which is parallel thereto. The same holds true for signatures. Therefore, when a roll consists of square folded sheet-like products, or other products wherein one marginal portion is thicker than the marginal portion which is parallel thereto, the roll of convoluted products is not a true cylinder but rather a truncated cone having a larger-diameter first end face which is formed by the thicker marginal portions and a smaller-diameter second end face which is formed by the (thinner) marginal portions extending in parallelism with the thicker marginal portions. It is assumed here that the winding operation involves advancing the sheet-like products in such a way that the thicker marginal portions are delivered in a direction at right angles to the axis of rotation of the core.

Published German patent application No. 2 207 556 of Gsegnet discloses a winding apparatus which employs a single flexible band having a width greater than the width of the stream of products which are to be convoluted onto a roll. Thus, if the apparatus is to be used to form rolls of square folded sheet-like products, the roll will invariably constitute a conical frustum because the wind band which is employed by Gsegnet is not designed to subject select portions of the growing roll or of the fully grown roll to different compressive stresses. Frustoconical rolls create problems during winding, in storage, during transport, as well as during unwinding. For example, the band or bands are likely to run askew. The situation is aggravated when the winding apparatus is used in a publishing house or in another establishment wherein the characteristics of products which necessitate temporary storage in the form of rolls often vary within a wide range, i.e., the difference between the thicker and thinner marginal portions is not always the same so that the conicity of the rolls varies in dependency upon changes of such differences. The ratio of thicknesses of the thicker marginal portion and of the marginal portion which is parallel thereto can vary in dependency on the number of sheets in a square folded or analogous product and/or in dependency on the quality of the material of the sheets. Therefore, the formation of frustoconical rolls in the apparatus of Gsegnet could not be avoided even by a most careful selection of the elasticity, stretchability and certain other important parameters of the flexible band or bands because it would be necessary to employ a different band for each of a wide variety of different products. The utilization of bands exhibiting certain specific properties (such as a selected resistance to tensional stresses and/or others) would contribute significantly to the cost of the apparatus and would render such cost prohibitive for many potential uses.

Published German patent application No. 33 15 496 proposes to employ a single relatively narrow band which is to be convoluted around the rotating core and around the adjacent convolutions of sheet-like products in zig-zag formation or in the form of a sine curve extending to both sides of the central symmetry plane of the roll (the symmetry plane extends at right angles to the rotational axis of the core and is located midway between the two end faces of the roll). Reference may also be had to commonly owned U.S. Pat. No. 4,538,397 to Boss. Such mode of winding the band also fails to prevent the development of a frustoconical roll if the sheet-like products are square folded sheets or signatures.

Published German patent application No. 25 44 135 of Achelpohl et al. proposes to use two spaced-apart parallel narrow flexible bands to ensure reliable winding of sheet-like products which are supplied in the form of an imbricated stream. The arrangement is such that the convolutions of one band are located at a given distance from one end face of the roll, and the convolutions of the other band are located at the same distance from the other end face of the roll. Achelpohl et al. do not propose to alter the tensional stress upon the one and/or the other band; therefore their apparatus cannot prevent the formation of frustoconical rolls if the components of the imbricated stream are square folded sheets or other products wherein the thickness of at least one marginal portion exceeds the thickness of the other marginal portion or portions.

Published European patent application No. 0 316 563 of Merkli discloses an apparatus which also employs two narrow flexible bands disposed at the same distance from the adjacent end faces of the roll. Therefore, the apparatus of Merkli will turn out acceptable cylindrical rolls as long as the thickness of each sheet-like product is uniform throughout.

In the absence of an acceptable solution, the makers of winding apparatus have accepted that presently known apparatus cannot prevent the making of frustoconical rolls if the constituents of the rolls are square folded sheets, signatures and like products with thicker and thinner marginal portions. As a rule, presently utilized winding apparatus operate with a single relatively narrow band which is located midway between the end faces of the roll. Reference may be had to published European patent application No. 0 135 080 of Merkli. The single band is likely to form a constriction midway between the end faces of the roll so that the convoluted sheets form a substantially hourglass-shaped body which is acceptable in most instances as long as the diameters of the two end faces are at least substantially identical. Such configurations can be achieved if the thickness of each and every portion of each sheet-like product in the roll is the same.

If the difference between a relatively thick marginal portion and the marginal portion which is parallel thereto is very pronounced, one end face of the resulting frustoconical roll is likely to reach the maximum permissible diameter (e.g., for the purposes of storage or further manipulation) well before the roll contains that number of products which could be stored if the thickness of each product were the same throughout. This entails less than optimum utilization of conventional apparatus and increased space requirements for storage of a particular number of sheet-like products.

OBJECTS OF THE INVENTION

An object of the invention is to provide a novel and improved method of making rolls from convoluted sheet-like products of non-uniform thickness in such a way that the conicity of the rolls is less pronounced or does not develop at all.

Another object of the invention is to provide a novel and improved method of converting imbricated streams of square folded sheets, signatures or like products, or streams of non-overlapping square folded sheets, signatures and like products into rolls having at least substantially constant diameters from end to end.

A further object of the invention is to provide a novel and improved method of guiding and/or otherwise manipulating the flexible band or bands which are used for the practice of the above outlined method.

An additional object of the invention is to provide a novel and improved method of storing large numbers of square folded sheets, signatures and analogous products of non-uniform thickness in a small area.

Still another object of the invention is to provide a method which renders it possible to employ one and the same apparatus for efficient storage of square folded sheets and like products wherein the ratio of thicknesses of two parallel marginal portions varies or is likely to vary from batch to batch or from stream to stream.

A further object of the invention is to provide a novel and improved apparatus for the practice of the above outlined method and to construct and assemble the apparatus in such a way that it can form truly cylindrical rolls from square folded sheets, signatures and other products wherein the thickness of one marginal portion is likely to depart considerably from the thickness of one or more other marginal portions.

Another object of the invention is to provide the apparatus with novel and improved means for winding streams of partially overlapping or non-overlapping sheet-like products onto a rotary core.

An additional object of the invention is to provide the apparatus with novel and improved means for positioning the band or bands relative to the central symmetry plane of the roll which is formed on the rotary core.

A further object of the invention is to provide an apparatus which can automatically conform the position(s) of the band or bands to the ratio of thicknesses of marginal portions of square folded sheets, signatures and analogous products of non-uniform thickness.

SUMMARY OF THE INVENTION

One feature of the present invention resides in the provision of a method of storing successive products of a series of flexible sheet-like products (such as newspaper sections) which have substantially parallel first and second marginal portions and the first marginal portion is thicker than the second marginal portion (particularly because the products are square folded or similarly folded products). The storing is effected on a core which is to be rotated about a predetermined axis (e.g., about a substantially horizontal axis) and the storing is carried out with assistance from at least one flexible band having an end which is affixed to the core in such a way that the band is wound onto the rotating core. The method comprises the steps of conveying successive products of the series toward and against the rotating core so that the marginal portions of successively conveyed products are substantially normal to the axis of rotation, and successive products are confined between the core and the band and are wound onto the core to form a roll of neighboring convolutions which alternate with convolutions of the band and wherein the thus obtained growing roll has a central symmetry plane which is normal to the axis of rotation and the roll further comprises first and second end faces which are formed by the first and second marginal portions, respectively, and maintaining the convolutions of the at least one band between the symmetry plane and the first end face of the roll to thus influence the diameter of the first end face.

The maintaining step preferably includes selecting the distance of the convolutions of the at least one band from the symmetry plane as a function of the ratio of thicknesses of the first and second marginal portions of sheet-like products. The selecting step preferably includes increasing the distance of convolutions of the at least one band from the symmetry plane when the ratio of first and second thicknesses is greater, and reducing the distance when the ratio is smaller.

If the sheet-like products are to be stored with assistance from a plurality of discrete flexible bands (e.g., with assistance from two bands), the method preferably further comprises the step of altering or varying the distance of at least one of the plurality of bands form the symmetry plane so that the distance is increased when the aforementioned ratio of first and second thicknesses is greater, and the distance is reduced when the ratio is smaller. Such method preferably further comprises the step of keeping the convolutions of at least one other band of the plurality of bands at a substantially fixed distance from the symmetry plane. Such keeping step preferably includes maintaining the at least one other band between the symmetry plane and the second end face of the roll.

As a rule, the diameter of the first end face of the roll will tend to, or will actually, exceed the diameter of the second end face to an extent which is a function of the difference between the first and second thicknesses. Therefore, the improved method further comprises the step of maintaining the at least one band under tension so that the convolutions of the at least one band effect at least some compression of the roll at the first end face in order to at least reduce the difference between the diameters of the first and second end faces.

Another feature of the invention resides in the provision of an apparatus for storing successive products of a series of flexible sheet-like products which have substantially parallel first and second marginal portions the first of which is thicker than the second marginal portion. The apparatus comprises a core; a support which mounts the core for rotation about a predetermined (particularly a substantially horizontal axis), means for conveying successive products of the series toward and against the core in such orientation that the marginal portions of the conveyed products are substantially normal to the axis of rotation of the core, and means for winding successive products of the series onto the core so that the products form a roll having a central symmetry plane which is normal to the aforementioned axis and first and second end faces which are formed by the first and second marginal portions, respectively. The winding means comprises at least one elongated flexible band having an end which is connected to the core so that the band is wound onto the rotating core to form a plurality of convolutions which alternate with the convolutions of the roll. The winding means further comprises means for maintaining the convolutions of the at least one band between the symmetry plane and the first end face of the roll. The winding means further comprises a supply reel for the at least one band.

The means for maintaining can include means for altering the distance of the convolutions of the at least one band from the symmetry plane, and such means for maintaining can further include means for holding the convolutions of the at least one band at a selected distance from the symmetry plane. The altering means can include at least one motor.

The apparatus can also comprise means for monitoring the distance of the convolutions of the at least one band from the symmetry plane, and such monitoring means can be designed to generate signals which denote the distance of the convolutions of the at least one band from the symmetry plane. Such signals can be utilized to automatically alter the distance of the convolutions of the at least one band from the symmetry plane as a function of changes of the ratio of thicknesses of the first and second marginal portions of the sheet-like products.

The support can include or form part of or constitute a vehicle for the core and for at least a portion of the winding means. Such apparatus can further comprise a frame or housing for the conveying means, and the vehicle is movable to and from a position in which the conveyor means can deliver successive products of the series of products toward and against the core in the vehicle. The conveying means can frictionally engage and rotate the core or the growing roll on the core when the vehicle is moved to the aforementioned position.

If the means for rotating the core is not mounted in or on the aforementioned vehicle (e.g., if such rotating means is mounted in or on the frame for the conveying means), the apparatus preferably further comprises means for coupling the rotating means with the core when the vehicle is moved to the aforementioned position.

The altering means can include a first portion in or on the frame and a second portion in or on the vehicle. The two portions cooperate so that they can alter the distance of the convolutions of the at least one band from the predetermined plane when the vehicle is moved to the aforementioned position relative to the frame.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
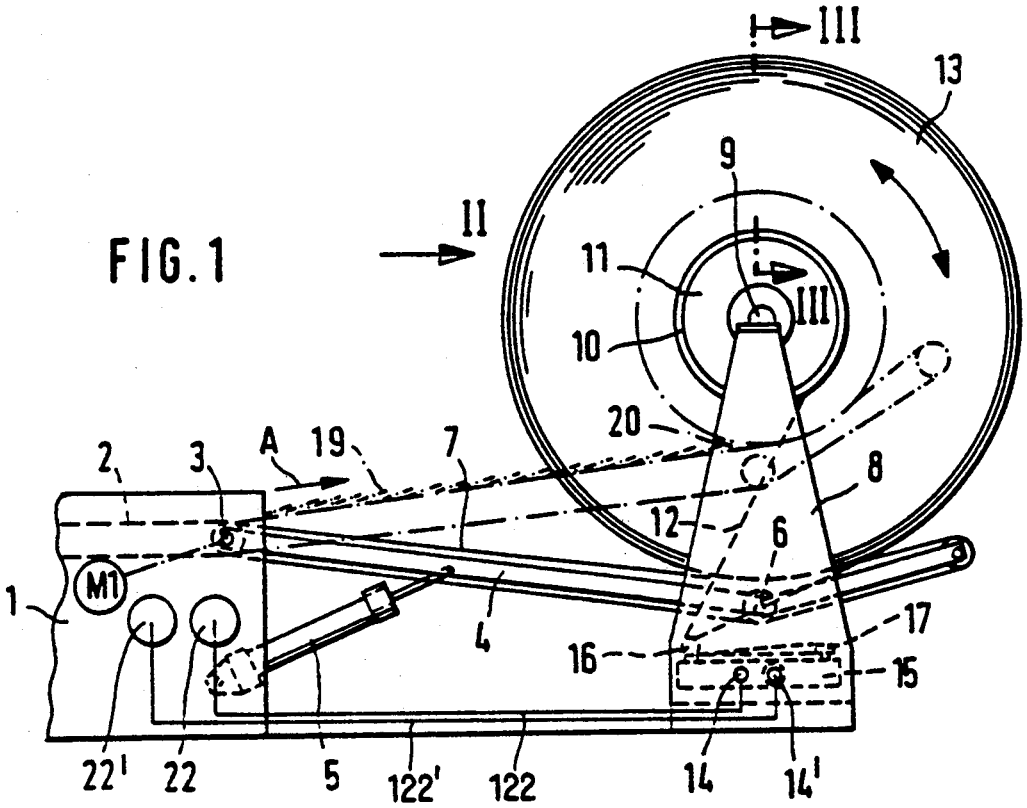
FIG. 1 is a schematic side elevational view of an apparatus which embodies one form of the invention and employs two flexible bands.
Figure 2:
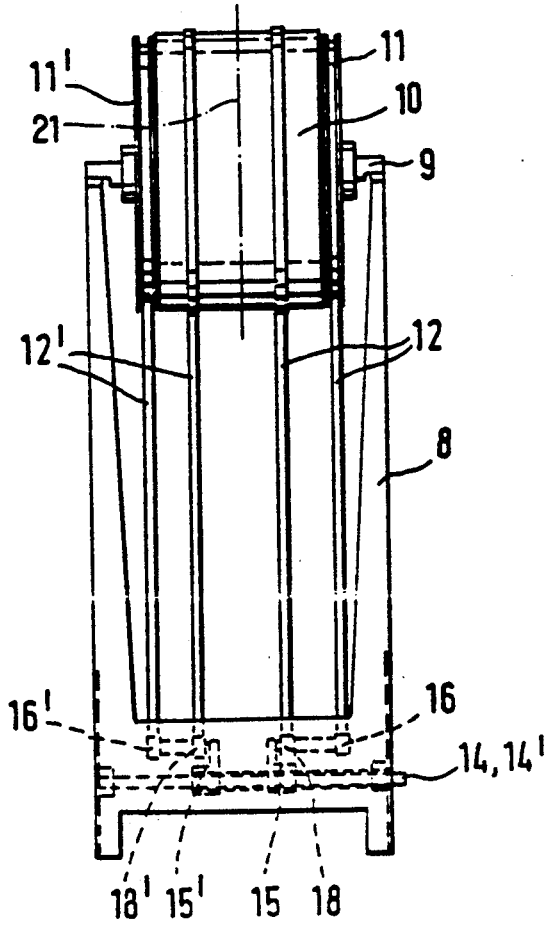
FIG. 2 is an end elevational view of a portion of the apparatus, substantially as seen in the direction of arrow II in FIG. 1.

Referring to FIGS. 1 and 2, there is shown an apparatus which serves to store a series of successive sheet-like products 19 on a rotary core 10. The apparatus comprises a stationary frame or housing 1 supporting an endless infeed belt conveyor 2 for a scalloped stream of partly overlapping products 19 which are fed in the direction of arrow A. The horizontal shaft 3 for the pulley or pulleys at the discharge end of the infeed conveyor 2 defines a pivot axis for a wiper 4 which can be pivoted about the axis of the shaft 3 by a fluid-operated (hydraulic or pneumatic) motor 5. The latter includes a single-acting or double-acting cylinder, a piston (not shown) in the cylinder and a piston rod articulately connected to an intermediate portion of the wiper 4. The lower end of the cylinder of the motor 5 is pivoted to the frame 1. The wiper 4 supports one or more endless belts 7 serving as a means for conveying successive products 19 of the scalloped stream toward and against the periphery of the core 10 or against the outermost convolution on a roll 13 which is in the process of growing on the core when the latter is driven to rotate in a counterclockwise direction (as viewed in FIG. 1). The belt or belts 7 are trained over pulleys 6 which are mounted on or in the wiper 4 and at least one of which is or can be driven to advance the upper reach(es) of the belt(s) in the direction of arrow A.

By way of example, the shaft 3 can be driven by a motor M1 which is thus designed to drive the infeed conveyor 2 as well as the belt or belts 7. However, it is equally within the purview of the invention to provide a first prime mover for the infeed conveyor 2 and a discrete second prime mover for the belt or belts 7 of the means for conveying successive products 19 of the scalloped stream in the direction of arrow A and all the way to the core 10 or to the growing roll 13 on the core.

The core 10 is rotatable (clockwise and counterclockwise) about the axis of a horizontal shaft 9 which is journalled in the upper portion of a stationary or mobile support 8. The support 8 can be fixedly mounted on the floor in the position of FIG. 1, i.e., adjacent the frame 1 so that the belt or belts 7 can deliver products 19 to the core 10 or to the roll 13. Alternatively, the support 8 can be mounted on wheels or skids or can be designed to be engaged by a fork lift or by any other transporting machine, not shown, so that it can be moved between the illustrated position for reception of products 19 from the conveying means (belt or belts 7) and a second position for temporary storage of a fully grown roll 13 or for unwinding of the convolutions of roll 13 so that the products 19 can be accepted and transported away by a suitable take-off conveyor, not shown. Reference may be had, for example, to commonly owned U.S. Pat. No. 4,752,176 to Linder which discloses a mobile support for a rotary core as well as apparatus which can be used to accept products 19 from a roll of convoluted products. If the support 8 is stationary, the belt or belts 7 and the conveyor 2 are preferably designed to move the products 19 in a direction (arrow A) toward the core 10 as well as in the opposite direction. Production lines employing large numbers of mobile supports for rotary cores as well as numerous apparatus for supplying sheet-like products to and for receiving sheet-like products from cores on mobile supports can be used with advantage in newspaper processing plants, particularly to deliver sections to inserting machines for the assembly of weekend editions or daily editions of newspapers.

The illustrated core 10 is freely rotatable on the shaft 9. The means for rotating the core 10 in the winding direction (i.e., counterclockwise, as seen in FIG. 1) includes the belt or belts 7 (hereinafter referred to in singular, i.e., as a belt). Thus, the motor 5 can pivot the wiper 4 while the belt 7 is driven to deliver a series of successive partially overlapping products 19 toward and against the core 10 whereby the core is set in rotary motion and gathers a growing roll 13 of products. The core 10 is rotated in response to frictional engagement with the driven belt 7 (and more particularly in response to frictional engagement with the oncoming products 19 on the belt 7), or in response to frictional engagement of the outermost convolution of the growing roll 13 with the products 19 on the adjacent portion of the upper reach of the belt 7. The latter is biased against the peripheral surface of the core 10, or against the outermost convolution of the growing roll 13, by the piston rod of the motor 5 which tends to pivot the wiper 4 in a counterclockwise direction.

The means for winding successive products 19 of the series of products supplied by the conveyor 2 and belt 7 includes two elongated flexible bands or strips 12, 12' each of which has a first end (not specifically shown) separably or fixedly connected to the core 10 and a second end which is connected to the respective reel or spool 11, 11' on the shaft 9. The reels 11, 11' are disposed at opposite axial ends of the core 10. The first ends of the bands 12, 12' are connected to the core 10 in such a way that, when the core is rotated in a direction to build a growing roll 13, the bands 12, 12' form convolutions 12*a*, 12*a*' (see FIG. 3) which alternate with convolutions consisting of partly overlapping products 19 whereby the convolutions 12*a*, 12*a*' prevent shifting of temporarily stored products 19 relative to the core 10.

The reels 11, 11' are braked in a conventional manner (for example, as disclosed in commonly owned U.S. Pat No. 4,523,751 which corresponds to published European patent application No. 0 135 080 of Merkli) to ensure that the bands 12, 12' are maintained under requisite tension, i.e., under a tension which suffices to prevent any uncontrolled or excessive shifting of those products 19 which form part of the roll 13. The reels 11, 11' are driven to collect the respective bands 12, 12' during unwinding of convolutions of products 19 from the core 10. Thus, the bands 12, 12' are maintained under tension irrespective of the direction of rotation of the core 10. The means for braking and the means for driving the reels 11, 11' can be mounted outside of the support 8 (as disclosed, for example, in the aforediscussed published European patent application No. 0 135 080 of Merkli) or by a mechanism which derives motion from the core 10 (e.g., in a manner as described in commonly owned copending Swiss patent application No. 3334/90.

The motor M1 serves as a means for rotating the core 10 and is coupled to the core by the wiper 4, motor 5 and belt 7 when the support 8 assumes the position of FIG. 1.

In accordance with a feature of the invention, the apparatus of FIGS. 1 and 2 further comprises means for maintaining the convolutions (12*a*, 12*a*') of the band 12 and/or 12' at a selected (and preferably variable or alterable) distance from a central symmetry plane 21 of the roll 13. In the embodiment of FIGS. 1 and 2, the symmetry plane 21 is common to the roll 13 and to the core 10 and is located midway between the two end faces EF1 and EF2 of the growing or fully grown roll 13 (see FIG. 3). The means for maintaining the convolutions of the band 12 and/or 12' at a selected distance from the symmetry plane 21 (and hence from the respective end face EF1 or EF2 of the roll 13) can be said to form part of the aforementioned winding means which further includes the bands 12, 12' and their reels 11, 11', respectively.

Certain details of the maintaining means are shown schematically in FIGS. 1 and 2. The maintaining means includes two horizontal rotary externally threaded feed screws or spindles 14, 14' which are rotatably journalled in the support 8 beneath the core 10, shaft 9 and reels 11, 11' and are parallel to the shaft 9 (i.e., they extend at right angles to the symmetry plane 21).

The spindles 14, 14' respectively mate with internally threaded nuts 15, 15' which are non-rotatably installed in or on the support 8 so that they move axially of their spindles when the spindles are driven to rotate in a clockwise or in a counterclockwise direction. Each spindle can receive torque from a discrete reversible motor (22, 22') mounted in or on the frame 1 and being operatively connected with the respective spindle (as at 122, 122') when the support 8 is properly docked at the frame 1, either permanently or in such a way that it can be advanced to the aforementioned take-off conveyor or conveyors, not shown. A first portion (122*a*, 122*a*'—see FIG. 9) of each of the two schematically shown operative connections 122, 122' is mounted on or in the frame 1, and a second portion (122*b*, 122*b*'—FIG. 9) of each such connection is mounted on or in the support 8. The two portions 122*a*, 122*b* and 122*a*', 122*b*' are or can be automatically coupled to each other (note the couplings 33, 33' in FIG. 9) so that the connection 122 can transmit torque from the motor 22 to the spindle 14 and that the connection 122' can transmit torque from the motor 22' to the spindle 14' when the apparatus of FIGS. 1 and 2 is to be adjusted by shifting the non-convoluted portion of the band 12 and/or 12' toward or away from the symmetry plane 21.

If the motors 22, 22' are mounted on the support 8, they can be directly or indirectly coupled to the respective spindles 14, 14'. The energy source for the motors 22, 22' (if such motors are mounted on or in the support 8) can be provided in or is accessible by way of the frame 1; the energy source is then connected with the motors 22, 22' on the support 8 in automatic response to docking of the support in the position which is shown in FIG. 1. The motors 22, 22' can be operated by electrical energy or by a pressurized (hydraulic or pneumatic) fluid. All that counts is to ensure that the motors 22, 22' or their equivalents can be set in operation (if necessary) before the making of a roll 13 begins so as to ensure that the convolutions (12*a*, 12*a*') of the band 12 and/or 12' will be located at a selected optimum distance from the symmetry plane 21. It is presently preferred to install the motors 22, 22' in or on the frame 1 (or in or on another stationary part) and to provide operative connections 122, 122' (with suitable couplings 33, 33' to separate the fixedly mounted portions 122*a*, 122*b* from the mobile portions 122*a*', 122*b*' of the connections) which can drivingly connect the motors 22, 22' with the respective spindles 14, 14' when the apparatus is ready to begin with the winding of products 19 onto the core 10.

The nuts 15, 15' on the spindles 14, 14' carry deflecting elements in the form of shafts, pins, pulleys or sheaves which serve to direct the unwound portions of the bands 12, 12' from their reels 11, 11' toward the peripheral surface of the core 10. The deflecting and other guide elements for the band 12 are preferably mirror images of the deflecting and other guide elements for the band 12'; therefore, the following description of such parts will deal only with deflecting and guide means for the non-convoluted portion of the band 12.

As mentioned above, one end of the band 12 is separably or more or less permanently connected to the core 10, and the other end of this band is separably or more or less permanently connected to the reel 11. The band 12 extends from the reel 11 downwardly and away from the shaft 9 to a deflecting element 16 in the form of a pulley or pin, and thence substantially horizontally to a second deflecting element 17 (e.g., a pulley or a pin). The band portion between the deflecting elements 16 and 17 is twisted through an angle of substantially 90°. The next portion of the band 12 extends from the deflecting element 17 to a third deflecting element (not shown) behind the element 17 and is deflected at an angle of 90° by the element 17 and again by the non-illustrated deflecting element whence the band extends to a fourth deflecting element 18 which is coaxial with the deflecting element 16 and is mounted on the nut 15. The band 12 thereupon extends from the deflecting element 18 substantially tangentially of and toward the periphery of the core 10, and its inclination relative to a tangent to the peripheral surface of the core 10 changes at a rate which is proportional to the rate of growth of the roll 13.

When the apparatus of FIGS. 1 and 2 is in actual use, the upper reach of the belt 7 on the wiper 4 delivers a continuous scalloped stream of sheet-like products 19 into the nip 20 of the core 10 and the adjacent portions of the bands 12, 12' and thereupon into the nip of these bands with the adjacent outermost convolution of the growing roll 13. If the thickness of each product 19 is constant (e.g., if each product 19 constitutes a single sheet of paper or other flexible sheet material), the exact distances of convolutions 12*a*, 12*a*' of the bands 12, 12' from the symmetry plane 21 are of no particular importance because the roll 13 will constitute or closely resemble a cylinder wherein the diameter of one end face (at one side of the plane 21) is identical or at least closely approximates the diameter of the other end face (at the other side of the plane 21).

However, the situation is quite different if the thickness of sheet-like products 19 is not uniform, e.g., if each such product is a so-called square folded product or a signature having a first marginal portion M1 (FIG. 3) which is thicker (and often much thicker) than the marginal portion M2 which is parallel thereto. Thus, and in the absence of any undertakings to the contrary, the stream of square folded products 19 would grow into a frustoconical body wherein the end face EF1 is formed by the thicker marginal portions M1 and the opposite end face EF2 is formed by the thinner marginal portions M2.

Figure 3:
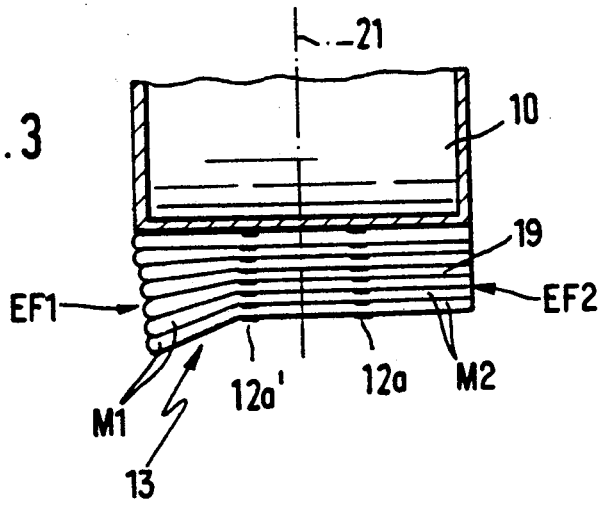
FIG. 3 is a fragmentary axial sectional view of the core and of a roll thereon, substantially as seen in the direction of arrows from the line III—III in FIG. 1, the left hand band being shown in a position corresponding to that in a conventional apparatus.
Figure 4:
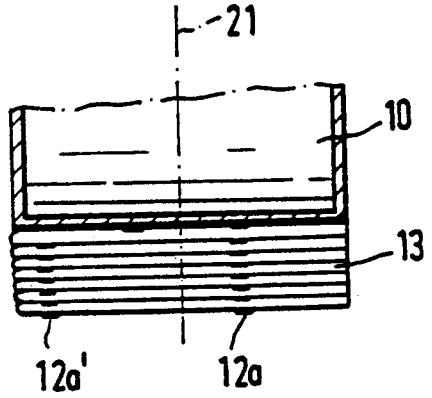
FIG. 4 is a sectional view similar to that of FIG. 3 but showing the left-hand band in a position in which the apparatus can be used for the practice of the improved method.

In accordance with the present invention, and as can be seen by comparing FIGS. 3 and 4, the apparatus can be used to build out truly, or at least substantially, cylindrical rolls 13 by the novel expedient of altering the distance of the convolutions 12*a*' from the symmetry plane 21 as a function of the difference between the thicknesses of the marginal portions M1 and M2. The arrangement is such that the convolutions 12*a*' of the band 12' are moved nearer to the end face EF1 and the band 12' is maintained under requisite tension to compress the thicker marginal portions M1 in the growing and fully grown roll 13 whereby the diameter of the end face EF1 is reduced accordingly. All this is achieved by the simple expedient of starting the motor 22' which shifts the nut 15' along the spindle 14' so that the convolutions 12*a*' are formed at a greater distance from the symmetry plane 21.

FIG. 3 shows that the convolutions 12*a* are located at a first distance from the plane 21 and that the convolutions 12*a*' are located at a second distance from the plane 21 whereby the second distance matches or at least closely approximates the first distance. Such guidance of the bands 12, 12' is highly satisfactory or is ideally suited for the making of rolls 13 from sheet-like products of constant thickness (i.e., wherein the thickness of M1 equals or closely approximates the thickness of M2).

In order to ensure that the bands 12 and 12' will immediately and predictably react to clockwise or counterclockwise rotation of the respective spindles 14 and 14', the aforediscussed deflecting elements (including those shown at 16, 16', 17, 18 and 18'') can be provided with pairs of flanges or other suitable means for compelling the respective portions of the bands to immediately move toward or away from the symmetry plane 21 (i.e., away from or toward the end face EF1, EF2, respectively) when the motor 22 and/or 22' is started to rotate the respective spindle 14, 14' in a clockwise or in a counterclockwise direction. Such compelling means can also comprise ball or roller bearings or needle bearings with readily rotatable races which engage the adjacent edge faces of the bands to shift them longitudinally of the spindles and to establish the locations for the formation of convolutions 12a, 12a' at optimal distances from the symmetry plane 21. The distances of the convolutions 12a, 12a' from the symmetry plane 21 are proportional to the selected distances of deflecting elements 18, 18' (e.g., flanged pulleys, sheaves or pins) from the symmetry plane 21.

FIG. 4 shows that the distance of the convolutions 12a' from the symmetry plane 21 greatly exceeds the distance of such plane from the convolutions 12a. Therefore, and if the band 12' is capable of standing pronounced or reasonable tensional stresses, it compresses the marginal portions M1 to thus reduce the diameter of the end face EF1 so that the diameter of this end face equals or only slightly exceeds the diameter of the end face EF2. Thus, one obtains a truly or practically cylindrical roll 13 which can be more readily manipulated and can store a larger number of products 19 than a frustoconical roll having a maximum diameter (at its end face EF1) which matches the diameter of the end face EF1 in FIG. 4.

The adjustability of shiftability of the band 12 in the axial direction of the core 10 can serve the purpose of adjusting the compressive stress upon the products 19 in the region between the symmetry plane 21 and the end face EF2 if the diameter of the end face EF1 does not equal or approximate the diameter of the end face EF2, even at a time when the convolutions 12a' are close or very close to the end face EF1. It has been found that the adjustability or shiftability of the band 12' as well as of the band 12 enables the person or persons in charge (or an automatic regulator) to rapidly and reliably adjust or alter the shape of the roll 13 when the shape of the growing roll departs from a truly cylindrical shape, i.e., when the diameter of the end face EF1 departs from the diameter of the end face EF2.

Figure 5:
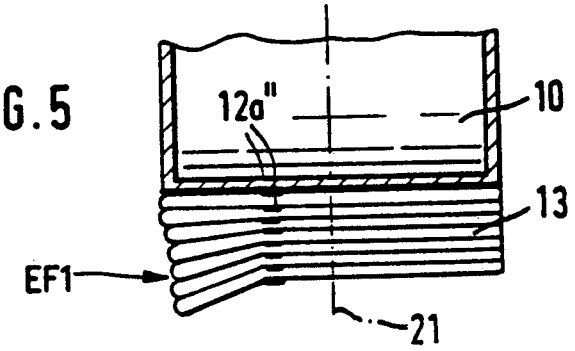
FIG. 5 is a similar sectional view of a portion of a modified apparatus with a single band which is shown out of that (optimum) position in which it prevents or reduces the likelihood of formation of a conical roll.

FIG. 5 shows that one of the bands 12, 12' and the associated reel, spindle, nut and deflecting elements can be dispensed with, i.e., it suffices to provide a single band which operates between the symmetry plane 21 and the end face EF1 and is adjustable by the respective motor 22', connection 122', spindle 14', nut 15' and deflecting elements including those shown in FIG. 2 at 16' and 18'). This enables the convolutions 12a'' of FIG. 5 to engage the adjacent convolutions of the roll 13 at a selected distance from the end face EF1. In such apparatus, the single band (including the convolutions 12a'') constitutes a means for preventing unwinding of convolutions of the roll 13 and also as a means for imparting to the roll 13 a cylindrical or nearly cylindrical shape by compressing the marginal portions M1 (at the end face EF1). An apparatus which employs a single band can be used with particular advantage for the making of relatively small rolls. The diameters of rolls which contain convoluted newspaper sections are or can be in the range of several meters.

Figure 6:
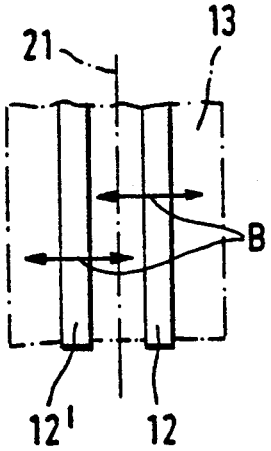
FIG. 6 is a fragmentary side elevational view of a roll and of two bands each of which is adjustable in the axial direction of the roll.
Figure 7:
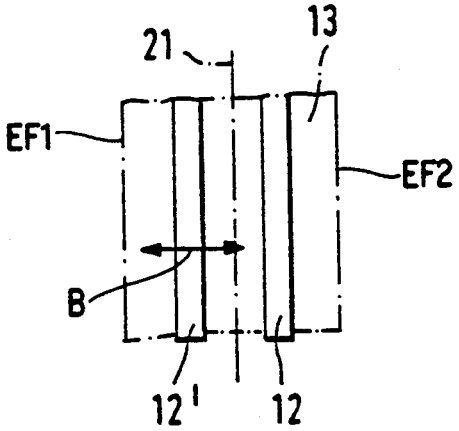
FIG. 7 is a similar side elevational view but showing two bands only one of which is to be adjusted in the axial direction of the roll.
Figure 8:
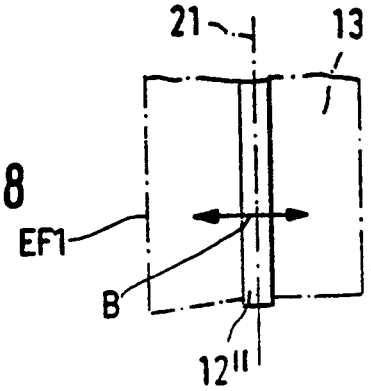
FIG. 8 is a view similar to that of FIG. 6 or 7 but showing single band which is adjustable in the axial direction of the roll.

The double-headed arrows B which are shown in FIG. 6 denote that each of the two bands 12, 12' can be caused to move its convolutions 12a, 12a' (not shown in FIG. 6) toward or away from the symmetry plane 21. Thus, such apparatus is identical with or clearly analogous to the apparatus of FIGS. 1 and 2. FIG. 7 shows a modification with two bands 12, 12' only one of which (namely the band 12') is shiftable to move its convolutions toward or away from the symmetry plane 21, i.e., away from or toward the adjacent end face EF1 of the roll 13 which is indicated by phantom lines. FIG. 8 shows a portion of an apparatus which is analogous to that including the structure of FIG. 5, i.e., the winding means employs a single band 12'' which can be adjusted to move its convolutions nearer to or further away from the end face EF1 and is or can be disposed between the symmetry plane 21 and the end face EF1.

The convolutions of the band 12 in the apparatus of FIG. 7 are maintained at a fixed distance from the symmetry plane 21, e.g., exactly midway between the plane 21 and the end face EF2.

An advantage of the apparatus which embodies the structure of FIG. 8 (a single band 12'') is its simplicity. The apparatus embodying the structure of FIG. 7 is more complex because its winding means comprises two discrete bands 12 and 12' but the adjusting or altering means is relatively simple because only one adjusting mechanism (including the motor 22', connection 122', spindle 14', nut 15' and deflecting elements including those shown at 16' 18' suffices to prevent the development of frustoconical rolls. The apparatus of FIGS. 1, 2, 3, 4 and 6 is somewhat more complex; however, its versatility is highly satisfactory because the shape of the roll 13 can be influenced at the end face EF1 as well as at the end face EF2.

The improved apparatus is susceptible of many additional modifications without departing from the spirit of the invention. For example, the spindles 14, 14' and the nuts 15, 15' can be replaced with suitable levers and/or links which can effect controlled movements of the convolutions 12a and/or 12a' toward or away from the symmetry plane 21. Furthermore, the apparatus can be simplified by mounting the reels 11, 11' on the respective nuts 15, 15' so that the aforedescribed deflecting elements (or at least some of these deflecting elements) can be dispensed with. The flanges of the reels 11, 11' which are mounted directly on the nuts 15, 15' ensure that the belts 12, 12' are compelled to properly react to clockwise or counterclockwise rotation of the respective spindles 14, 14', i.e., that the convolutions 12a and/or 12a' are caused to migrate toward or away from the symmetry plane 21, depending upon the selected direction of rotation of the respective spindles.

Figure 9:
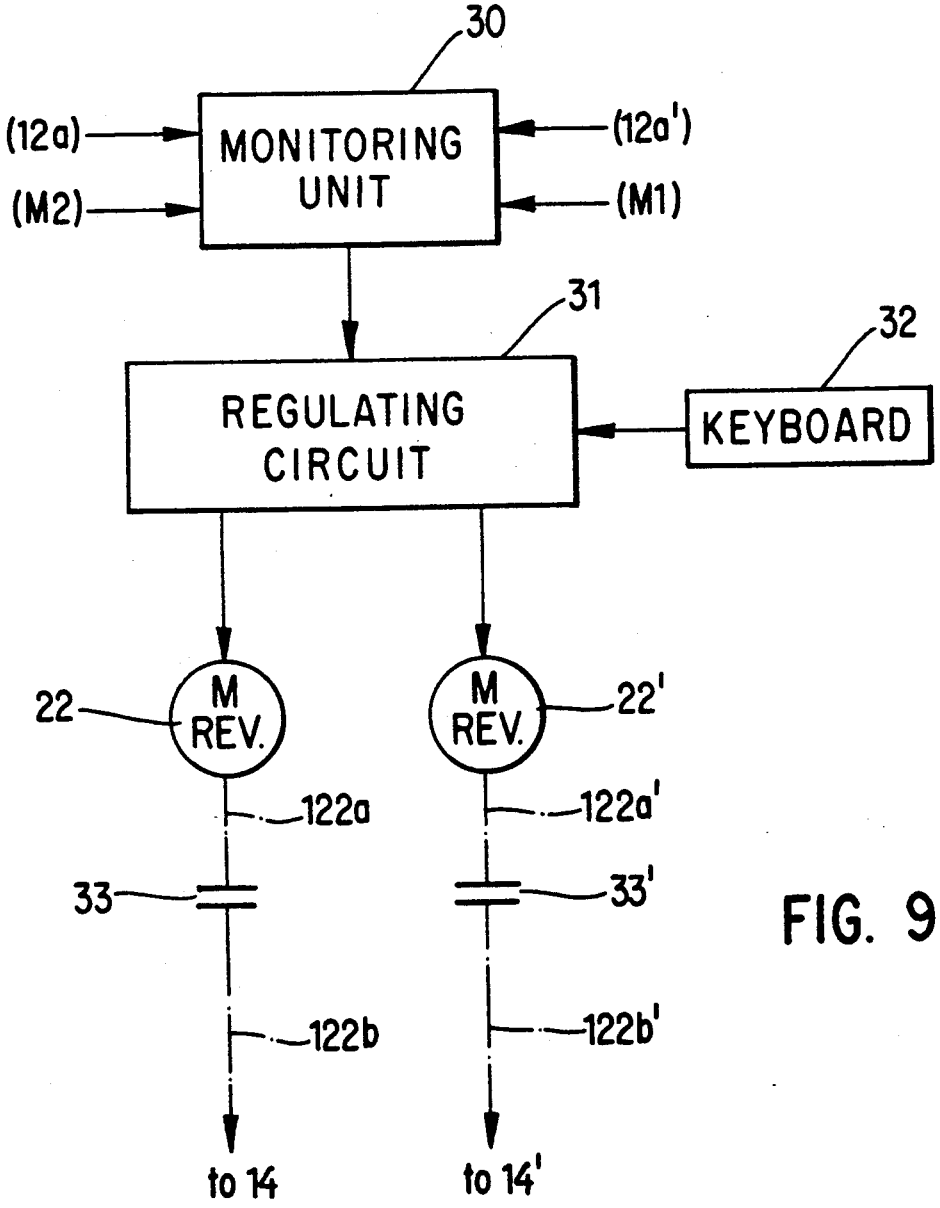
FIG. 9 is a diagrammatic view of an automatic system for operating the distancing altering means in the band winding means in the apparatus of FIGS. 1 and 2.

FIG. 9 is a diagrammatic view of means (note the unit 30) for monitoring the ratio of thicknesses of the marginal portions M1, M2 of products 19 on the infeed conveyor 2, on the belt 7 or on a conveyor (not shown) which supplies products to the conveyor 2. The output of the unit 30 transmits appropriate signals to the corresponding input of a regulating circuit 31 with outputs connected to the controls for the motors 22 and 22'. A keyboard 32 is or can be provided to control the operation of the motors 22, 22' by way of the regulating circuit 31 independently of the thickness monitoring unit 30. FIG. 9 further shows the stationary portions 122a, 122a' and the mobile portions 122b, 122b' of the operative connections 122, 122'. The portions 122a, 122b are connectable to each other by the disengageable coupling 35, and the portions 122a', 122b' are connectable with each other by the disengageable coupling 33'.

The couplings 33, 33' become operative in response to transport of the support 8 to the position of FIG. 1. This support can be said to constitute a vehicle for the core 10, its shaft 9, the reels 11, 11', the bands 12, 12' and those parts of the adjusting or altering means for the locations of the convolutions 12*a*, 12*a'* which are mounted on or in the support.

The operation of the circuitry of FIG. 9 is or can be such that the monitoring unit 30 is set in operation to ascertain the difference between the thicknesses of the marginal portions M1 and M2 of square folded sheets, signatures or analogous sheet-like products when a support (vehicle) 8 with an empty core 10 thereon is properly positioned relative to the frame 1. The circuit 31 evaluates the information from the unit 30 and operates the motors 22, 22' (if necessary) in order to select an optimum position of the convolutions 12*a'*, i.e., a distance of such convolutions from the symmetry plane 21 which is properly related to the ratio of thicknesses of marginal portions M1 and M2 of the products 19 which are about to be stored on the empty core 10 adjacent the frame 1. The circuit 31 preferably comprises a memory for storage of information pertaining to the selected positions of deflecting elements 18, 18' and the respective nuts 15, 15'.

The structure of FIG. 9 or an analogous system for automatically selecting the distances of convolutions 12*a* and/or 12*a'* from the symmetry plane 21 exhibits the advantage that it can be put to use while the apparatus is in the process of building a roll 13 on the rotating core 10.

The monitoring unit 30 can be used in addition to or in lieu of a system of sensors which monitor the difference between the diameters of end faces EFl, EF2 on a growing roll 13. Such sensors can also ensure that the diameter of the fully grown roll 13 will be constant all the way from the one to the other end face; at the very least, the diameter of the end face EF1 will not appreciably exceed the diameter of the end face EF2 even if the products 19 are square folded sheets or other commodities having a non-uniform thickness.

FIG. 9 further shows that the monitoring unit 30 has inputs which can receive signals denoting the distances of the convolutions 12 and 12*a'* from the symmetry plane 21. Such information is conveyed to the regulating circuit 31 for storage and for comparison with information denoting the thicknesses of marginal portions M1, M2 and/or with information denoting the ratio of thicknesses of the marginal portions M1 and M2.

The exact manner in which the unit 30 monitors (e.g., optically) the diameters of the end faces EF1 and EF2 and/or the locations of the convolutions 12*a* and 12*a'* forms no part of the present invention. Reference may be had, for example, to commonly owned U.S. Pat. No. 4,589,603 to Müller which discloses means for indirectly monitoring the diameter of the growing roll on a rotary core. This patent also discloses means for braking the supply or supplies of convoluted flexible band(s).

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of storing successive products of a series of flexible sheet-like products, having substantially parallel first and second marginal portions the first of which is thicker than the second thereof, on a core—which is rotated about a predetermined axis—with assistance from at least one flexible band having an end which is affixed to the core so that the band is wound onto the rotating core, comprising the steps of conveying successive products of the series toward and against the rotating core so that the marginal portions are substantially normal to the axis and successive products are confined between the core and the band and are wound onto the core to form a roll of neighboring convolutions alternating with convolutions of the band and wherein the roll has a central symmetry plane which is normal to the axis and first and second end faces formed by the first and second marginal portions, respectively; and maintaining the convolutions of the at least one band between the symmetry plane and the first end face of the roll.

2. The method of claim 1, wherein said maintaining step includes selecting the distance of the convolutions of the at least one band from the symmetry plane as a function of the ratio of thicknesses of the first and second marginal portions.

3. The method of claim 2, wherein said selecting step includes increasing the distance when the ratio is greater and reducing the distance when the ratio is smaller.

4. The method of claim 1 of storing sheet-like products with assistance from a plurality of discrete flexible bands, further comprising the step of altering the distance of at least one of the plurality of bands from the symmetry plane so that the distance is increased when the ratio of the first and second thicknesses is greater and the distance is reduced when the ratio is smaller.

5. The method of claim 4, further comprising the step of keeping the convolutions of at least one other band of the plurality of bands at a substantially fixed distance from the symmetry plane.

6. The method of claim 5, wherein said keeping step includes maintaining the at least one other band between the symmetry plane and the second end face of the roll.

7. The method of claim 1, wherein the diameter of the first end face of the roll tends to exceed the diameter of the second end face to an extent which is a function of the difference between the first and second thicknesses, and further comprising the step of maintaining the at least one band under tension so that the convolutions of the at least one band effect at least some compression of the roll at the second end face thereof to at least reduce the difference between the diameters of the first and second end faces.

8. Apparatus for storing successive products of a series of flexible sheet-like products which have substantially parallel first and second marginal portions the first of which is thicker than the second thereof, comprising a core; a support mounting said core for rotation about a predetermined axis; means for conveying successive products of the series toward and against the core in such orientation that the marginal portions of the conveyed products are substantially normal to said axis; and means for winding successive products of the series onto said core so that the products form a roll having a central symmetry plane which is normal to said axis and first and second end faces formed by the first and second marginal portions, respectively, said winding means comprising at least one elongated flexible band having an end which is connected to said core so that the band is wound onto the rotating core to form a plurality of convolutions which alternate with the convolutions of the roll, and means for maintaining the convolutions of the at least one band between said symmetry plane and the first end face of the roll.

9. The apparatus of claim 8, wherein said winding means further comprises a supply reel for said at least one band.

10. The apparatus of claim 8, wherein said means for maintaining includes means for altering the distance of the convolutions of said at least one band from said symmetry plane.

11. The apparatus of claim 10, wherein said means for maintaining further includes means for holding the convolutions of said at least one band at a selected distance from said symmetry plane.

12. The apparatus of claim 10, wherein said altering means includes at least one motor.

13. The apparatus of claim 10, further comprising means for monitoring the distance of the convolutions of said at least one band from said symmetry plane.

14. The apparatus of claim 13, wherein said monitoring means includes means for generating signals which denote the distance of the convolutions of said at least one band from said symmetry plane.

15. The apparatus of claim 8, further comprising means for automatically altering the distance of the convolutions of said at least one band from said symmetry plane as a function of changes of the ratio of thicknesses of the first and second marginal portions of sheet-like products.

16. The apparatus of claim 8, wherein said support includes or forms part of a vehicle for said core and for at least a portion of said winding means.

17. The apparatus of claim 16, further comprising a frame for said conveying means, said vehicle being movable to and from a position in which said conveying means can deliver successive products of the series of products toward and against the core in the vehicle.

18. The apparatus of claim 17, wherein said conveying means frictionally engages and rotates said core or the growing roll on the core when said vehicle is moved to said position.

19. The apparatus of claim 17, further comprising means for rotating said core and means for coupling said rotating means with said core, said rotating means being provided on said frame and said coupling means being operative in said position of said vehicle.

20. The apparatus of claim 17, wherein said means for maintaining includes means for altering the distance of the convolutions of said at least one band from said predetermined plane, said altering means including a first portion in said frame and a second portion in said vehicle and being operative to alter said distance in said position of said vehicle.

* * * * *